US009969593B2

(12) United States Patent
Ushigome et al.

(10) Patent No.: US 9,969,593 B2
(45) Date of Patent: May 15, 2018

(54) SHEET EJECTION DEVICE AND SHEET EJECTION METHOD

(75) Inventors: Tadaaki Ushigome, Ushiku (JP); Soichi Nakamura, Tsukuba (JP); Akehiro Kusaka, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 66 days.

(21) Appl. No.: 14/236,843

(22) PCT Filed: Aug. 2, 2012

(86) PCT No.: PCT/JP2012/069646

§ 371 (c)(1),
(2), (4) Date: Apr. 29, 2014

(87) PCT Pub. No.: WO2013/018849

PCT Pub. Date: Feb. 7, 2013

(65) Prior Publication Data

US 2014/0239576 A1 Aug. 28, 2014

(30) Foreign Application Priority Data

Aug. 4, 2011 (JP) ..... 2011-170772
Aug. 4, 2011 (JP) ..... 2011-170773

(51) Int. Cl.
*B65H 43/06* (2006.01)
*B65H 29/04* (2006.01)
(Continued)

(52) U.S. Cl.
CPC ..... *B65H 43/06* (2013.01); *B65H 29/041* (2013.01); *B65H 29/585* (2013.01); *B65H 29/62* (2013.01);
(Continued)

(58) Field of Classification Search
CPC ..... B65H 43/06; B65H 31/00; B65H 2407/10
(Continued)

(56) References Cited

U.S. PATENT DOCUMENTS 4,012,032 A * 3/1977 Rogers ..... 271/290
5,042,793 A * 8/1991 Miyake ..... 271/293
5,240,370 A 8/1993 Furukawa et al.
5,383,754 A * 1/1995 Sumida ..... B42C 1/125 412/1
5,538,490 A * 7/1996 Taniwa ..... B65H 31/00 19/2
6,272,987 B1 8/2001 Kamoda
8,172,215 B2 * 5/2012 Ichimura ..... B65H 29/041 270/58.02
(Continued)

FOREIGN PATENT DOCUMENTS

EP 2 243 736 A2 10/2010
JP 57-48559 A 3/1982
(Continued)

OTHER PUBLICATIONS

International Search Report for International Application No. PCT/JP2012/069646 and an English translation.

*Primary Examiner* — Thomas A Morrison
(74) *Attorney, Agent, or Firm* — Birch, Stewart, Kolasch & Birch, LLP

(57) ABSTRACT

A sheet ejection device includes: a paper ejection chain (22*b*) for conveying paper (W); a first pile (26) or a second pile (26*b*) having loading plates (27*a* or 27*b*) arranged in a multistage manner and used for loading the paper ejected from the paper ejection chain; a first beam sensor (62*a* or 62*b*), a second beam sensor (63*a* or 63*b*), and a third beam sensor (64*a* or 64*b*) for detecting an intrusion into the first pile or the second pile. The sheet ejection device further comprises: a plate upper-limit position detection sensor (58*a* or 58*b*) for detecting that the loading plate has been positioned at a plate upper-limit position (L2); and a control device (50) for, based on the detection signal of the plate upper-limit position detection sensor, neglecting (disabling) a command for stopping a driving device (printing machine), the command is issued by the first to third beam sensors.

6 Claims, 13 Drawing Sheets

(51) Int. Cl.

| | |
|---|---|
| ***B65H 33/00*** | (2006.01) |
| ***B65H 31/00*** | (2006.01) |
| ***B65H 31/04*** | (2006.01) |
| ***B65H 29/58*** | (2006.01) |
| ***B65H 29/62*** | (2006.01) |
| ***B65H 31/02*** | (2006.01) |
| ***B65H 31/24*** | (2006.01) |
| ***B65H 31/30*** | (2006.01) |
| ***B65H 43/08*** | (2006.01) |

(52) U.S. Cl.

CPC ..... *B65H 31/00* (2013.01); *B65H 31/02* (2013.01); *B65H 31/04* (2013.01); *B65H 31/24* (2013.01); *B65H 31/3063* (2013.01); *B65H 33/00* (2013.01); *B65H 43/08* (2013.01); *B65H 2301/4212* (2013.01); *B65H 2301/4213* (2013.01); *B65H 2301/4263* (2013.01); *B65H 2301/42252* (2013.01); *B65H 2405/332* (2013.01); *B65H 2407/10* (2013.01); *B65H 2511/51* (2013.01); *B65H 2511/511* (2013.01); *B65H 2513/512* (2013.01); *B65H 2553/412* (2013.01); *B65H 2553/416* (2013.01); *B65H 2801/21* (2013.01)

(58) Field of Classification Search

USPC ..... 271/278, 279, 287, 288, 292, 293, 296, 271/298, 301

See application file for complete search history.

(56) References Cited

U.S. PATENT DOCUMENTS

| | | | | |
|---|---|---|---|---|
| 2009/0020944 | A1* | 1/2009 | Ide et al. | 271/207 |
| 2010/0270737 | A1* | 10/2010 | Ichimura | 271/207 |

FOREIGN PATENT DOCUMENTS

| | | | |
|---|---|---|---|
| JP | 63-81071 | U | 5/1988 |
| JP | 63-101273 | A | 5/1988 |
| JP | 64-81762 | A | 3/1989 |
| JP | 2000-127349 | A1 | 5/2000 |
| JP | 2006-335525 | A | 12/2006 |
| JP | 2008-266003 | A | 11/2008 |
| WO | WO 2004/078626 | A1 | 9/2004 |

* cited by examiner

SHEET EJECTION DEVICE AND SHEET EJECTION METHOD

TECHNICAL FIELD

The present invention relates to a sheet discharging apparatus and a sheet discharging method provided in a sheet-fed offset printing press or the like.

BACKGROUND ART

Generally, in a printing work by a sheet-fed offset printing press, a sheet gripped and transported by a gripper supported by a travelling delivery chain is released from the gripping of the gripper after being printed and falls on a pile board to be piled. In such a discharging work, there are a method of discharging a large amount of sheets on one pile board and a method of piling a small amount of sheets on each of multiple pile boards. Moreover, the method of piling a small amount of sheets on each of multiple pile boards includes the following two methods. In one method, support pillars called corners are placed at four corners of a pile board on which sheets have been piled and another pile board is placed on the corners to stack the pile boards one on top of another. In another method, sheets are piled as follows. Endless chains are disposed at four corners outside a pile board in such a way as to travel in an up-down direction. A pile board is disposed to be supported by the four endless chains. The endless chains are made to travel to lower the pile board when a predetermined amount of sheets are piled on the pile board. Then, a new pile board is disposed to be supported above the pile board on which the sheets have been piled. Particularly, a discharging apparatus in which a small amount of sheets are piled on each of multiple pile boards by using endless chains is referred to as "circulating type" and description hereafter is given by using the circulating-type discharging apparatus as an example.

The circulating-type discharging apparatus is described in detail. The four endless chains disposed at the four corners outside the pile board travel synchronously with each other. In each of pairs of left and right endless chains as viewed in a direction in which the sheets are transported by grippers, multiple guide rails are attached to extend in a direction orthogonal to the sheet transporting direction, at equal intervals in a travelling direction of the pair of left and right endless chains, and a pile board called a delivery pile board is supported by a pair of front and rear guide rails in the direction in which the sheets are transported by grippers. In a circulating-type discharging apparatus configured as described above, when a predetermined amount of sheets are piled on a pile board supported by the pair of front and rear guide rail, the pile board is lowered by causing the four endless chains to synchronously travel. Then, the travelling of the endless chains is stopped when the guide rails above the guide rails supporting the pile board are set at predetermined positions. Another pile board is inserted into the pair of front and rear guide rails set at the predetermined positions from a lateral side of the discharging apparatus and the sheets are piled onto the new pile board. In other words, the operation of inserting the new pile board is repeated for each pitch of the guide rails and the sheets are thus piled in multiple stages (see Patent Document 1).

Moreover, such sheet discharging apparatuses include one in which, for example, three paper-sheet pile boards are arranged in a transporting direction of paper sheets. Specifically, first to third piles are provided and the first and second piles which are two piles on an upstream side in the transporting direction of the paper sheets are used for normal paper sheets. The normal paper sheets are alternately delivered onto the pile boards of these piles and piled in several stages. Meanwhile, the third pile on the most downstream side in the transporting direction of the paper sheets is used for sample paper sheets and waste paper sheets. The sample paper sheets and the waste paper sheets are delivered onto the pile board of the third pile and piled in fewer stages than those in the first pile and the second pile (see Patent Document 2).

PRIOR ART DOCUMENT

Patent Document

Patent Document 1: Japanese Patent Application Publication No. Sho 64-81762
Patent Document 2: Japanese Patent Application Publication No. 2000-127349
Patent Document 3: Pamphlet of International Patent Application Publication No. WO 2004/078626
Patent Document 4: Japanese Utility Model Registration Application Publication No. Sho 63-81071
Patent Document 5: Japanese Patent Application Publication No. Sho 63-101273

SUMMARY OF THE INVENTION

Problems to be Solved by the Invention

In such a sheet discharging apparatus, it is dangerous for an operator to enter, for example, access regions of the first to third piles while the delivery chain (printing press) is operating, an apparatus including a safety device is disclosed in Patent Document 3. The safety device stops a drive device (printing press) upon detecting the entry of the operator with a detector. Meanwhile, under a certain condition involving a predetermined switch operation by the operator, the safety device cancels the operation of the detector in a predetermined access region and allows the operator to perform a desired operation such as take-out and insertion of the pile boards in the predetermined access region, without stopping the drive device (printing press).

In this respect, an object of the present invention is to provide a sheet discharging apparatus and a sheet discharging method capable of automatically disabling an entry detector and performing a continuous operation while effectively securing safety.

Means for Solving the Problems

A sheet discharging apparatus for solving the problems described above is a sheet discharging apparatus including:

a sheet transporting device configured to transport sheets;

a pile having a plurality of stages of pile boards on which sheets discharged from the sheet transporting device are piled; and an entry detector configured to detect an entry into the pile and stop the sheet transporting device, characterized in that the sheet discharging apparatus comprises:

a sheet piling position detector configured to detect that the pile board is set at a sheet piling position; and a control device configured to disable the stopping of the sheet transporting device due to the detection by the entry detector, on the basis of a detection signal from the sheet piling position detector.

Moreover, the sheet discharging apparatus is characterized in that the sheet piling position of the pile board is a position at which an entry of an operator into the sheet transporting region is prevented.

Furthermore, the sheet discharging apparatus is characterized in that a cover is provided adjacent to the pile board set at the sheet piling position and the entry of the operator into the sheet transporting region is prevented by the cover and the pile board.

Moreover, the sheet discharging apparatus is characterized in that the sheet discharging apparatus further comprises:

a safety bar supported to be movable between an entry preventing position at which the entry into the pile is prevented and an opened position at which the entry into the pile is allowed; and a sensor configured to detect a position of the safety bar, and the control device controls a pile lifting motor configured to lift and lower the pile boards, on the basis of a detection signal from the sensor.

A sheet discharging method for solving the problems described above is a sheet discharging method in a sheet discharging apparatus including:

a sheet transporting device configured to transport sheets;

a pile having a plurality of stages of pile boards on which sheets discharged from the sheet transporting device are piled; and an entry detector configured to detect an entry into the pile and stop the sheet transporting device, characterized in that the sheet discharging method comprises the step of detecting that one of the pile boards is set at a sheet piling position and then disabling the stop of the sheet transporting device due to the detection by the entry detector.

Moreover, the sheet discharging method is characterized in that a plurality of the piles are provided in a sheet transporting direction in the apparatus and, when discharging of the sheets onto the pile board of an uppermost stage of one of the piles is completed, discharging of the sheets onto the pile board of an uppermost stage of another one of the piles is performed, and when the pile boards on which the sheets have been piled are to be taken out from the one pile, the steps of:

lowering the pile boards on which the sheets have been piled;

inserting a pile board into a stage at least two stages above the pile board of the uppermost stage on which the sheets have been piled;

lifting and setting the inserted pile board at the sheet piling position;

detecting that the inserted pile boards is set at the sheet piling position and disabling the stop of the sheet transporting device due to the detection by the entry detector; and taking out the pile boards on which the sheets have been piled by causing a piled paper-sheet take-out device to advance to and retreat from the apparatus are performed in this order.

Furthermore, the sheet discharging method is characterized in that, when the entry detector detects the entry into the apparatus while the drive stopping of the sheet transporting device due to the detection by the entry detector is disabled, drive of a pile lifting motor configured to lift and lower the pile boards is stopped.

Moreover, the sheet discharging method is characterized in that, when a sensor detects an opening operation of a safety bar disposed adjacent to the sheet transporting region while the drive stopping of the sheet transporting device due to the detection by the entry detector is disabled, drive of a pile lifting motor configured to lift and lower the pile boards is stopped.

Furthermore, the sheet discharging method is characterized in that an entry of an operator into a delivery chain travelling region above the pile in the sheet transporting device is prevented by the pile board set at the sheet piling position.

Effect of the Invention

The sheet discharging apparatus and the sheet discharging method of the present invention described above are capable of automatically disabling an entry detector and performing a continuous operation while effectively securing safety. Accordingly, the operation rate of a machine can be improved.

MODE FOR CARRYING OUT THE INVENTION

A sheet discharging apparatus and a sheet discharging method of the present invention is described below in detail by using an embodiment and the drawings.

Embodiment

Figure 1:
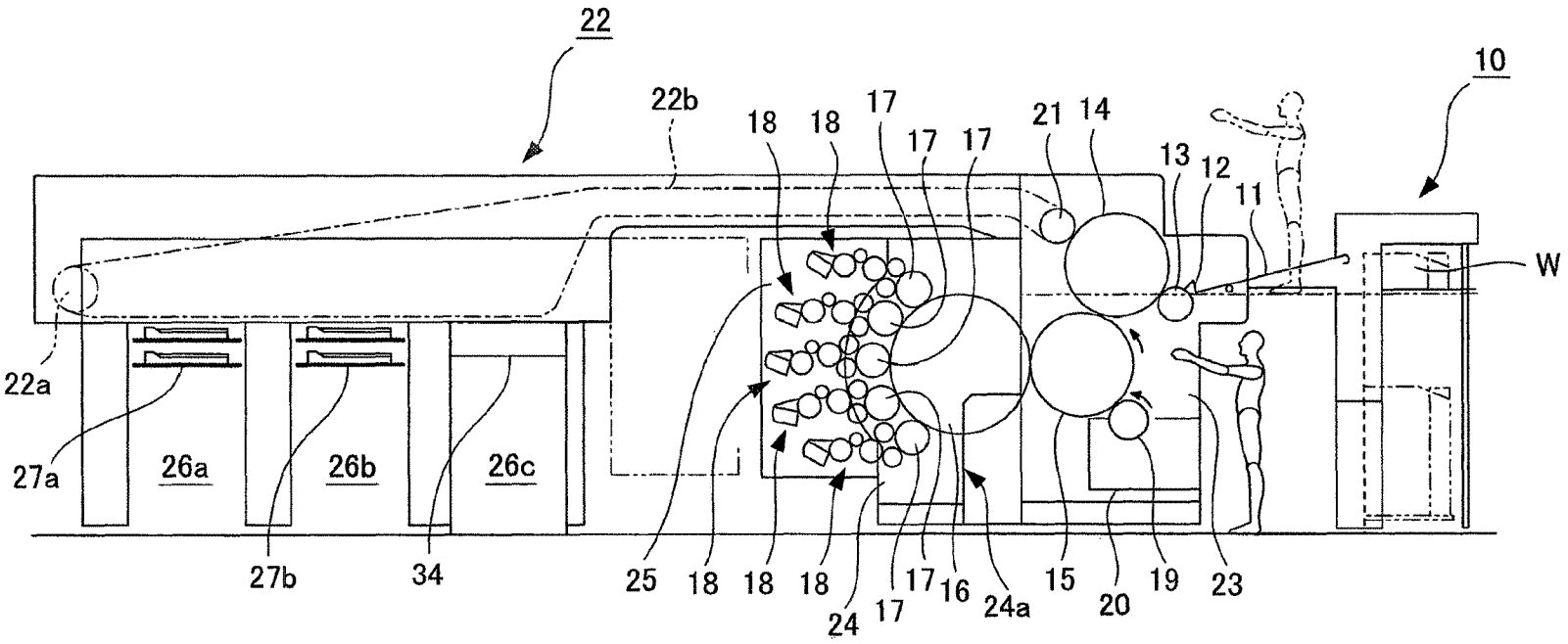
FIG. 1 is a schematic configuration diagram of an intaglio printing press which shows one embodiment of the present invention.
Figure 2:
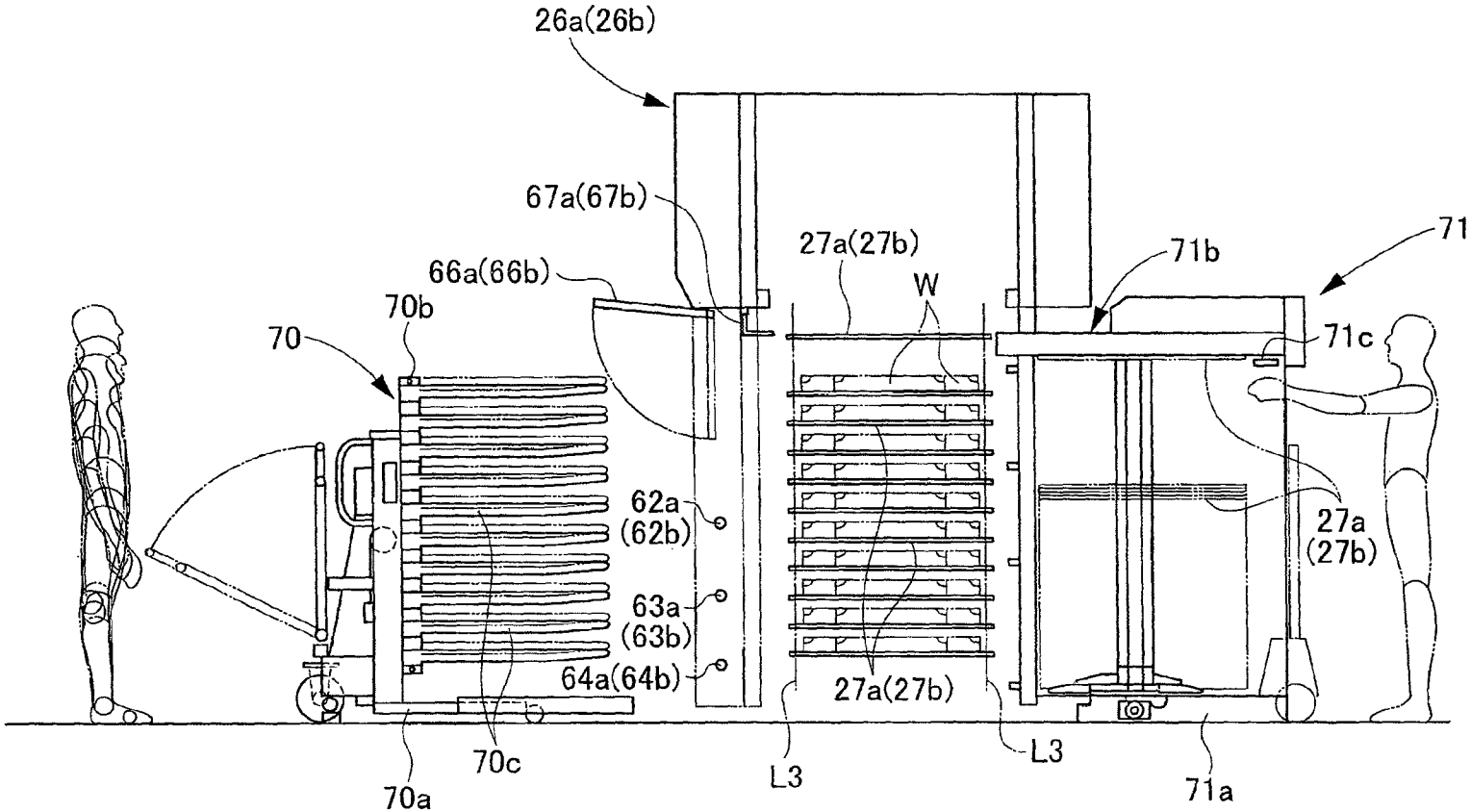
FIG. 2 is an explanatory diagram of a piled paper-sheet take-out device and a pile board introducing device in a delivery apparatus.
Figure 3:
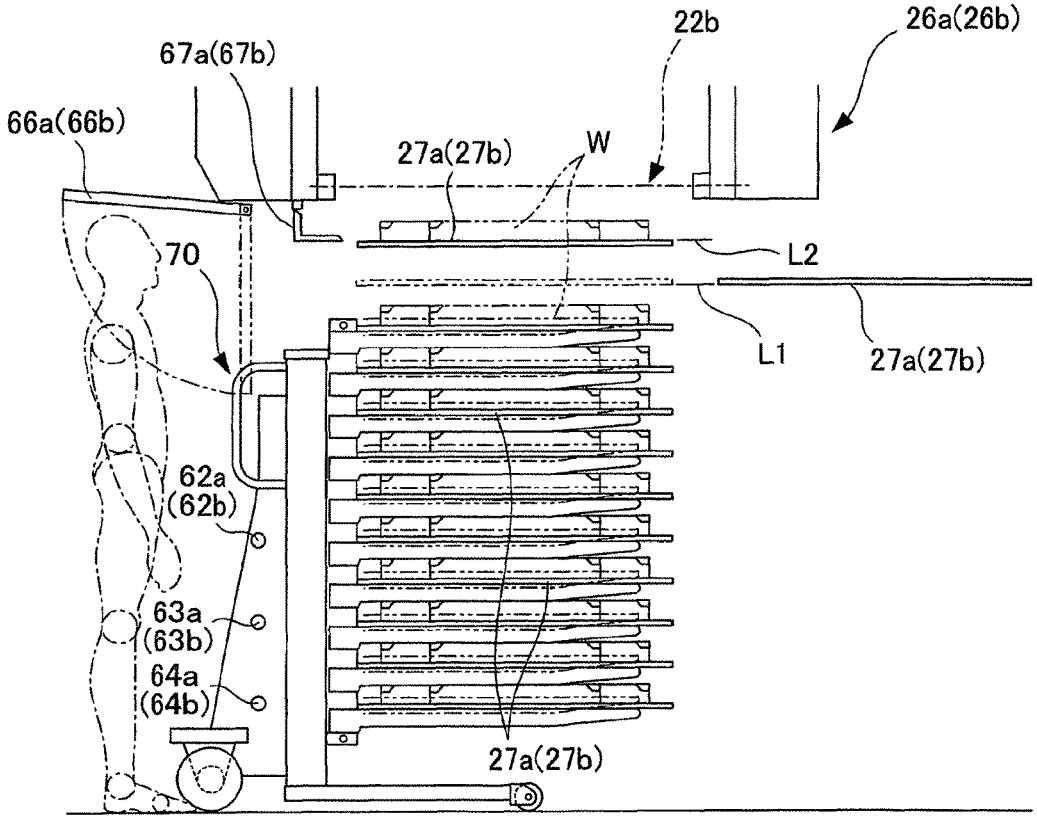
FIG. 3 is an explanatory diagram of a safety bar and the piled paper-sheet take-out device.
Figure 4:
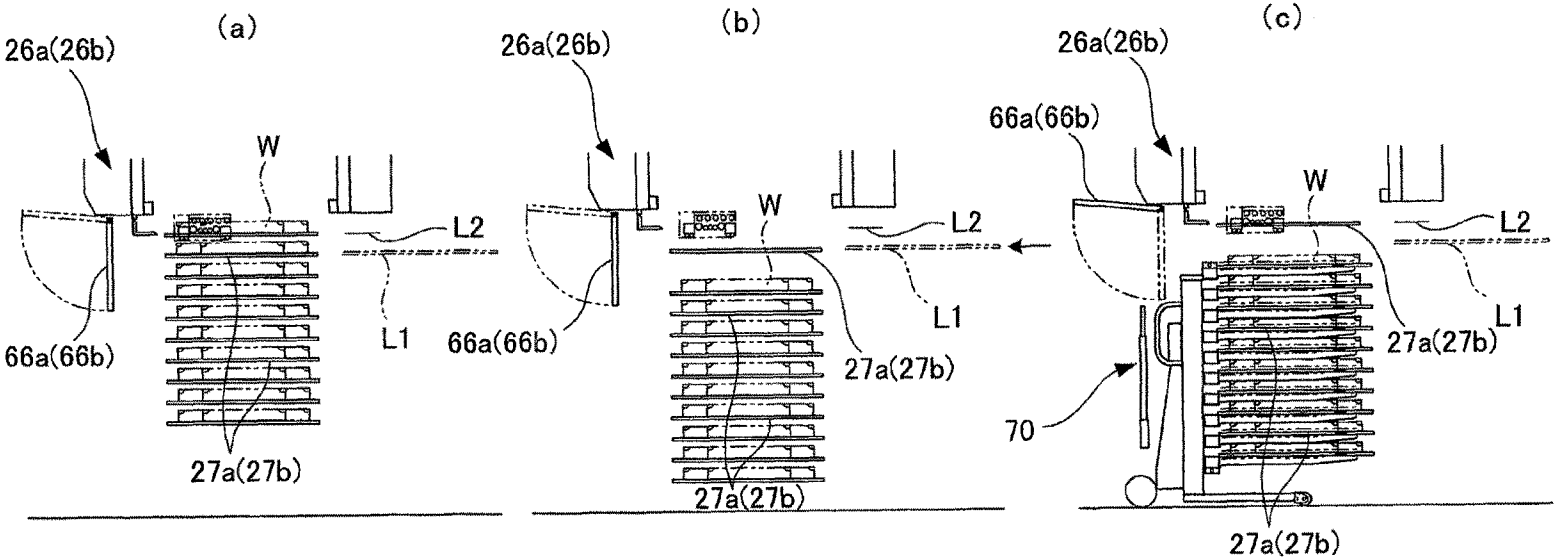
FIG. 4 is a schematic explanatory diagram of a discharging method.
Figure 5:
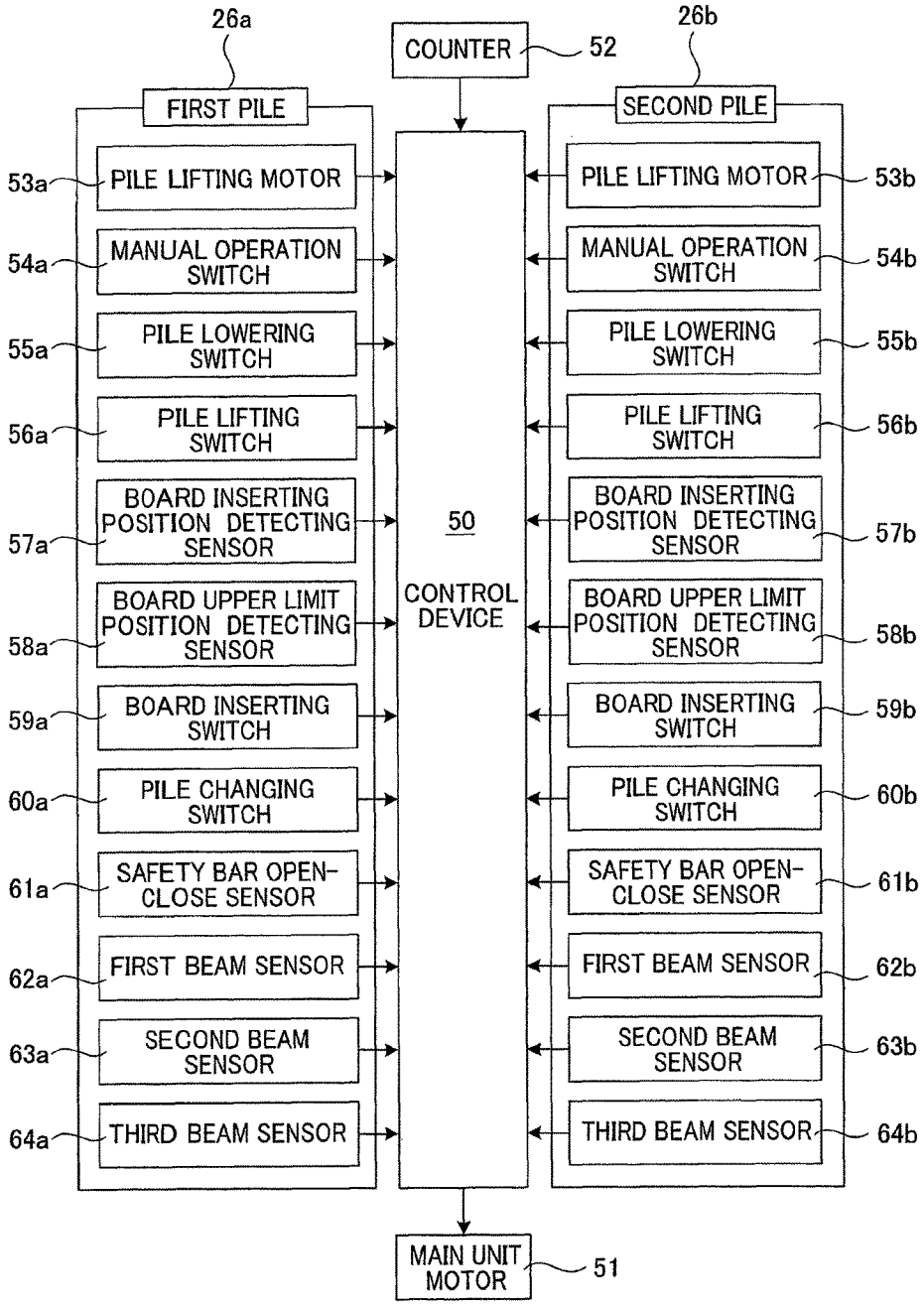
FIG. 5 is a control block diagram of the discharging apparatus.
Figure 6:
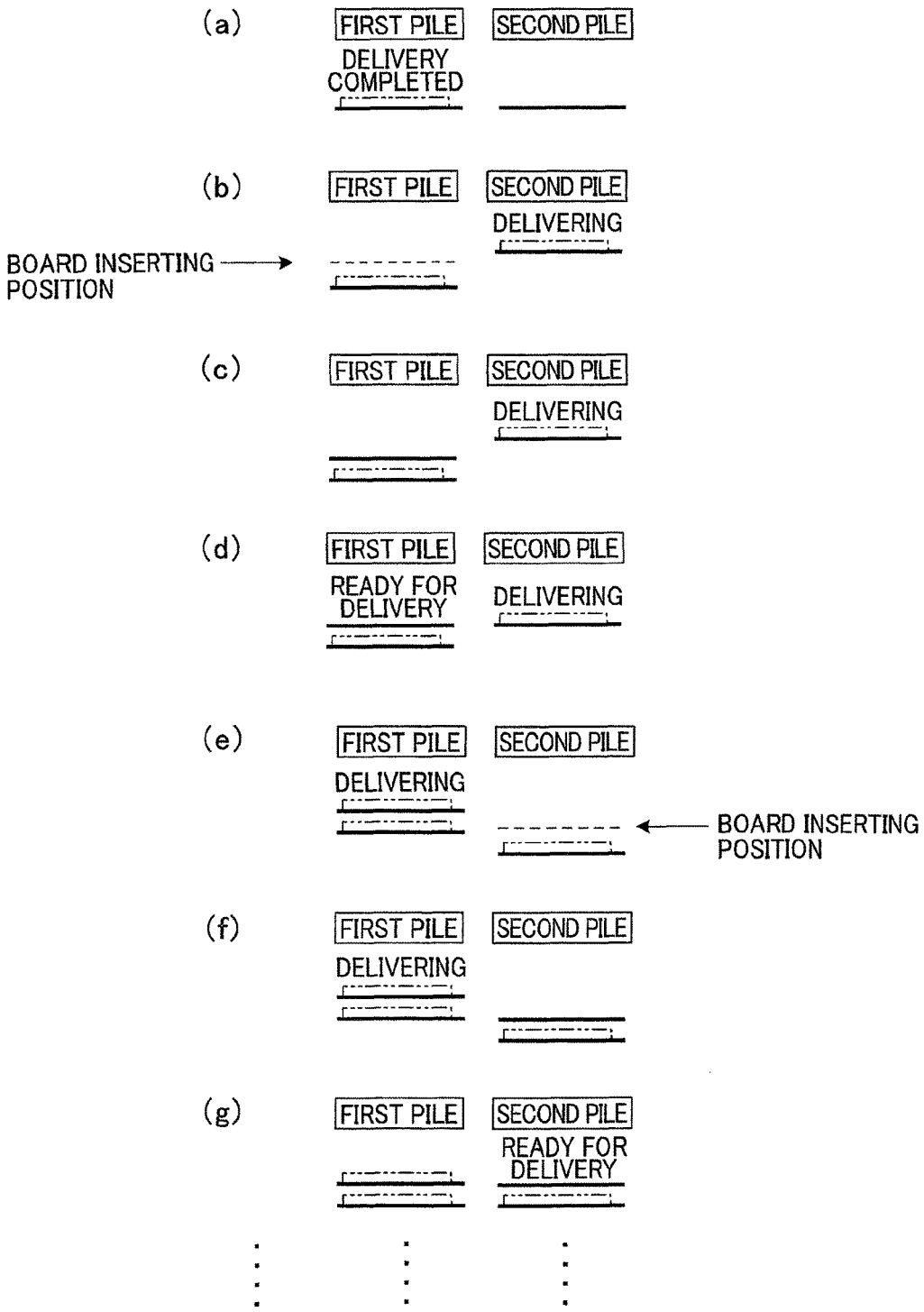
FIG. 6 is a view of steps in an automatic control of the discharging apparatus.
Figure 7:
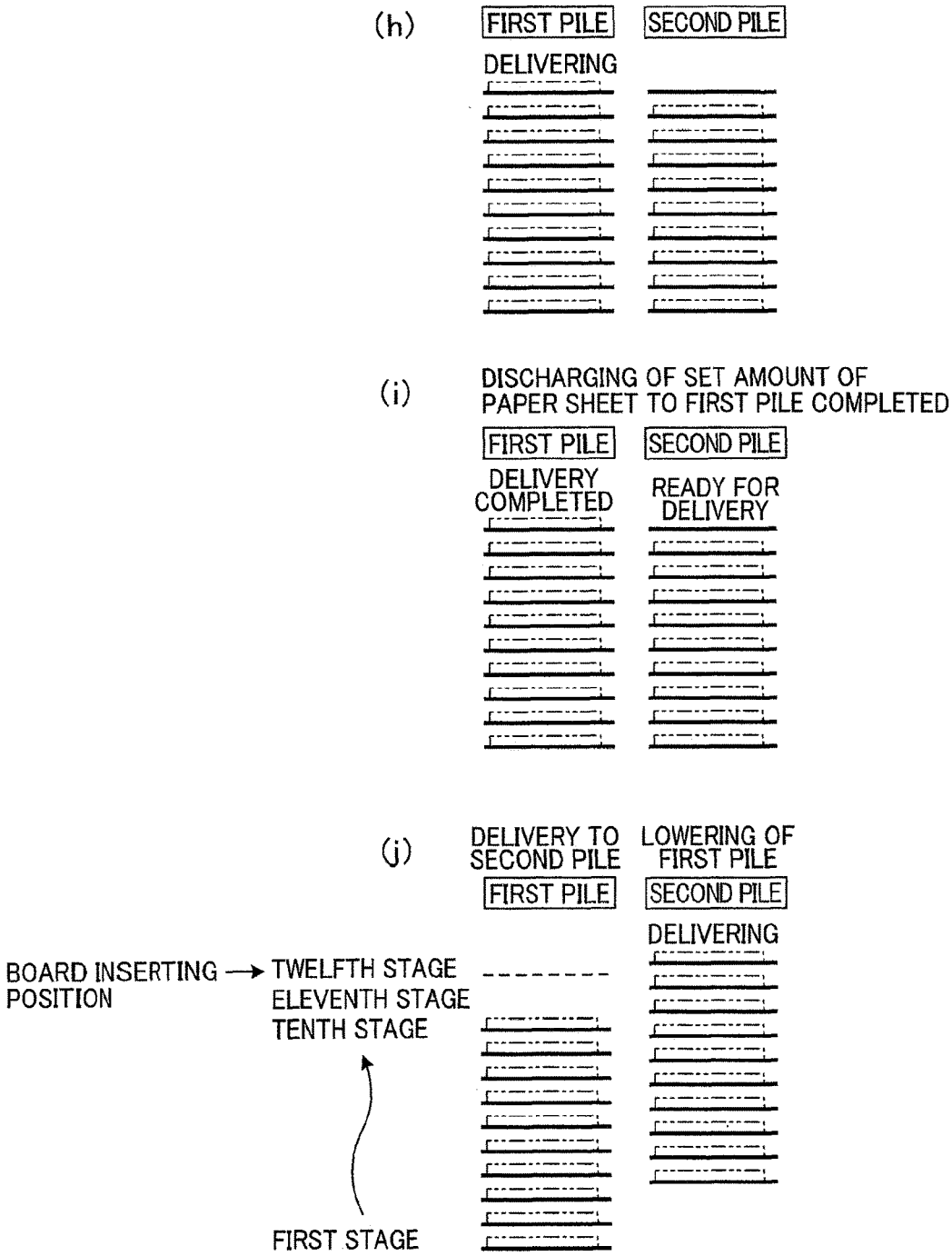
FIG. 7 is a view of steps in the automatic control of the discharging apparatus.
Figure 8:
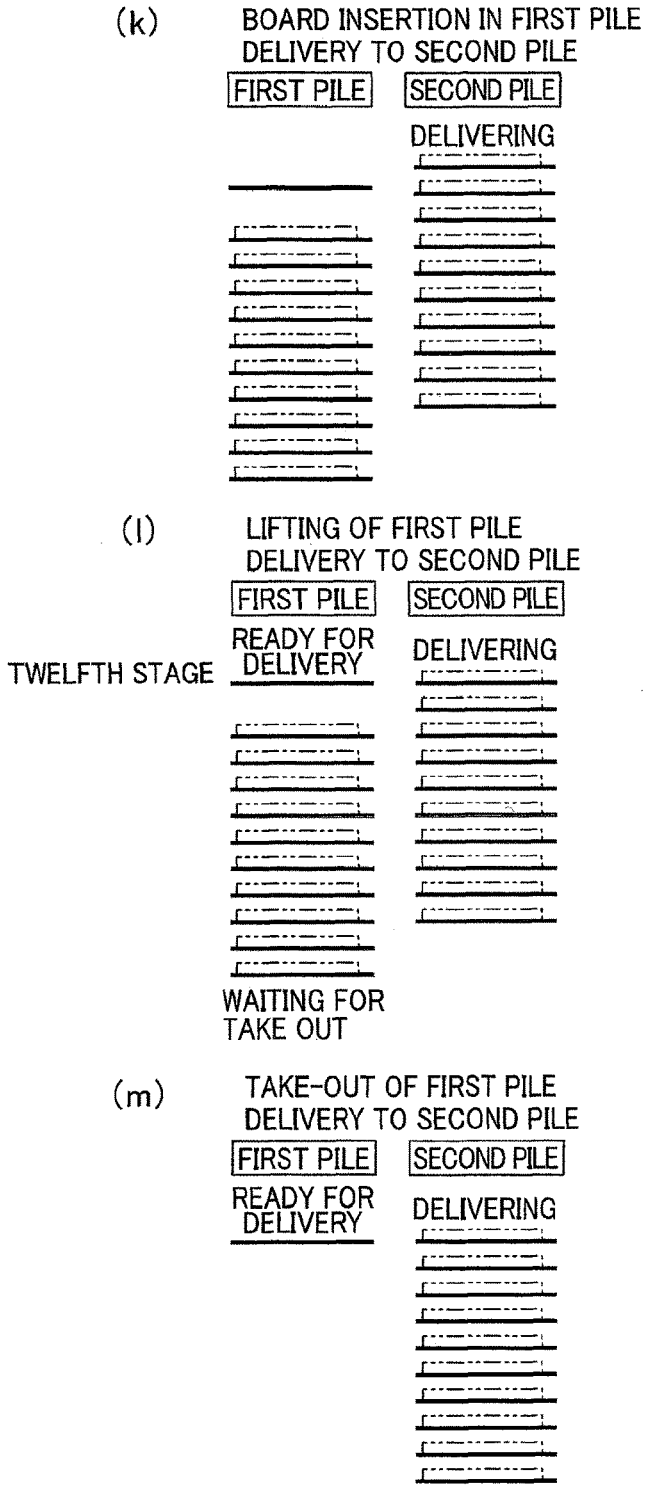
FIG. 8 is a view of steps in the automatic control of the discharging apparatus.
Figure 9:
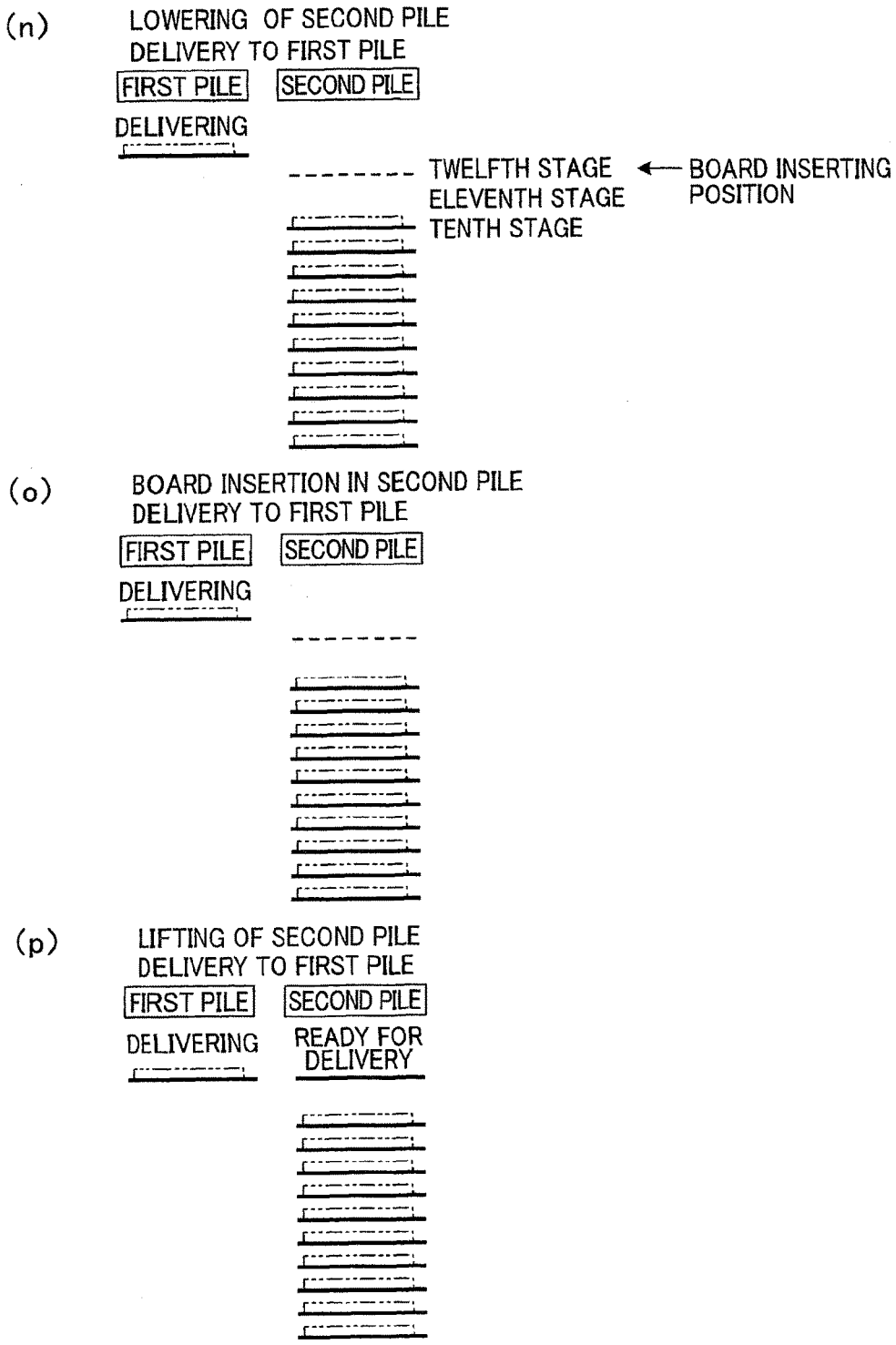
FIG. 9 is a view of steps in the automatic control of the discharging apparatus.
Figure 10:
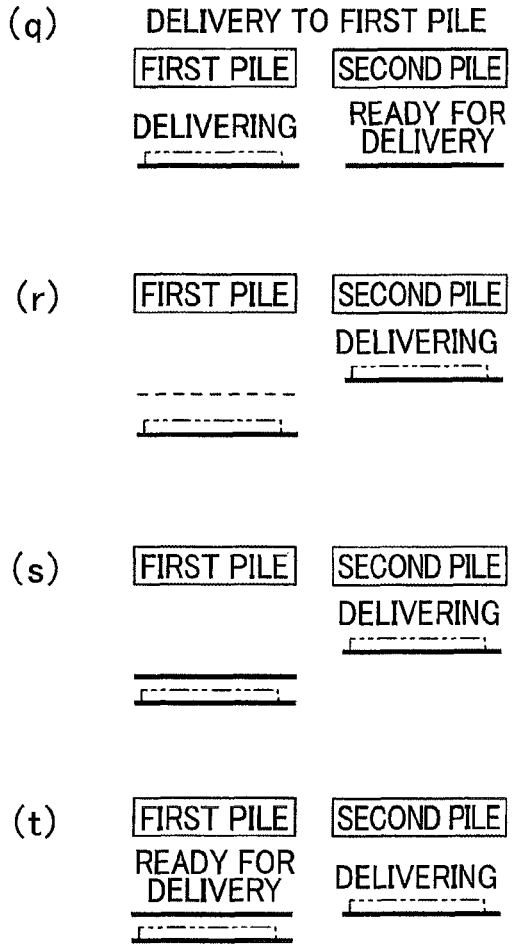
FIG. 10 is a view of steps in the automatic control of the discharging apparatus.
Figure 11:
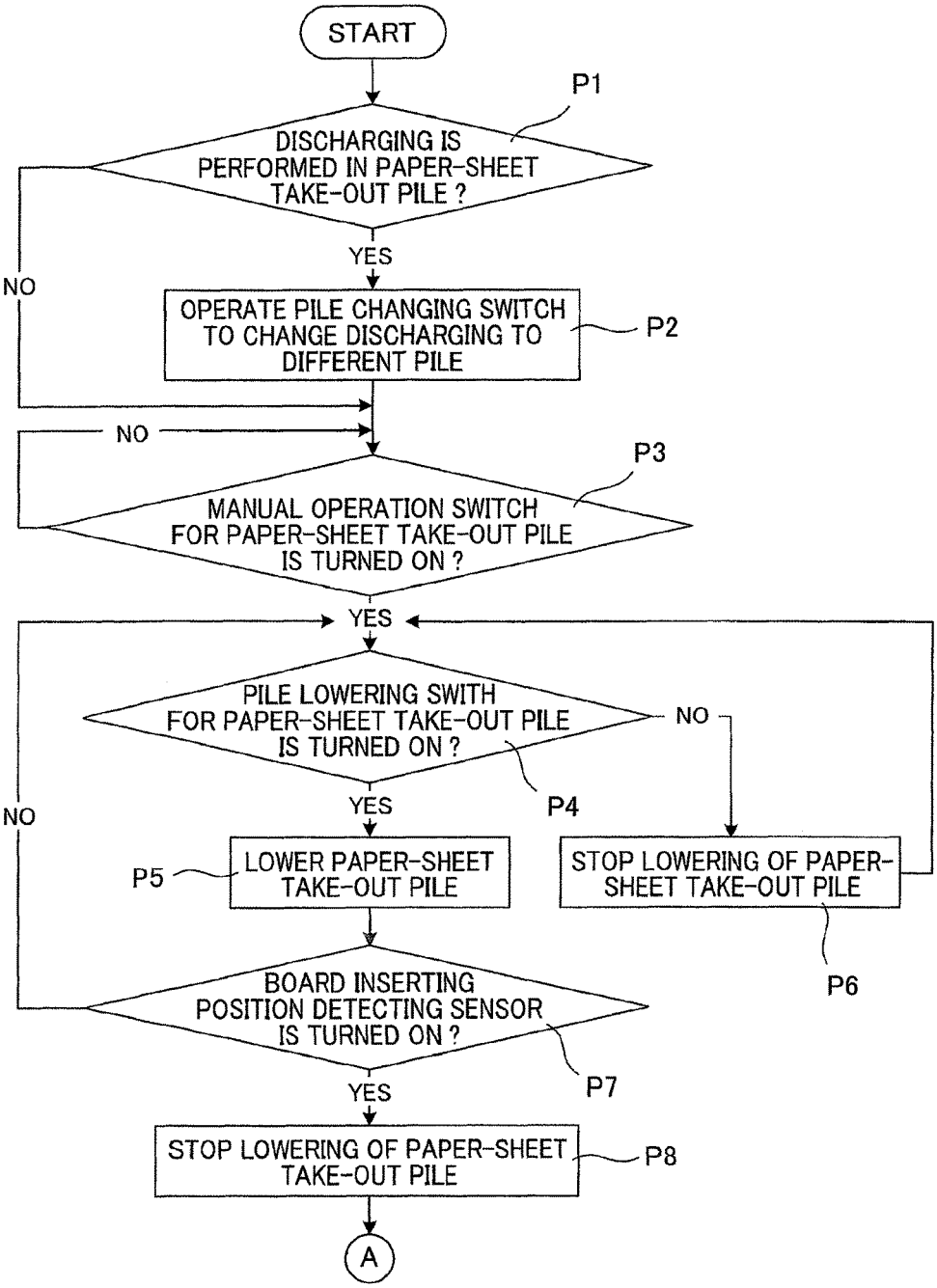
FIG. 11 is an operation flow diagram of a manual control in the discharging apparatus.
Figure 12:
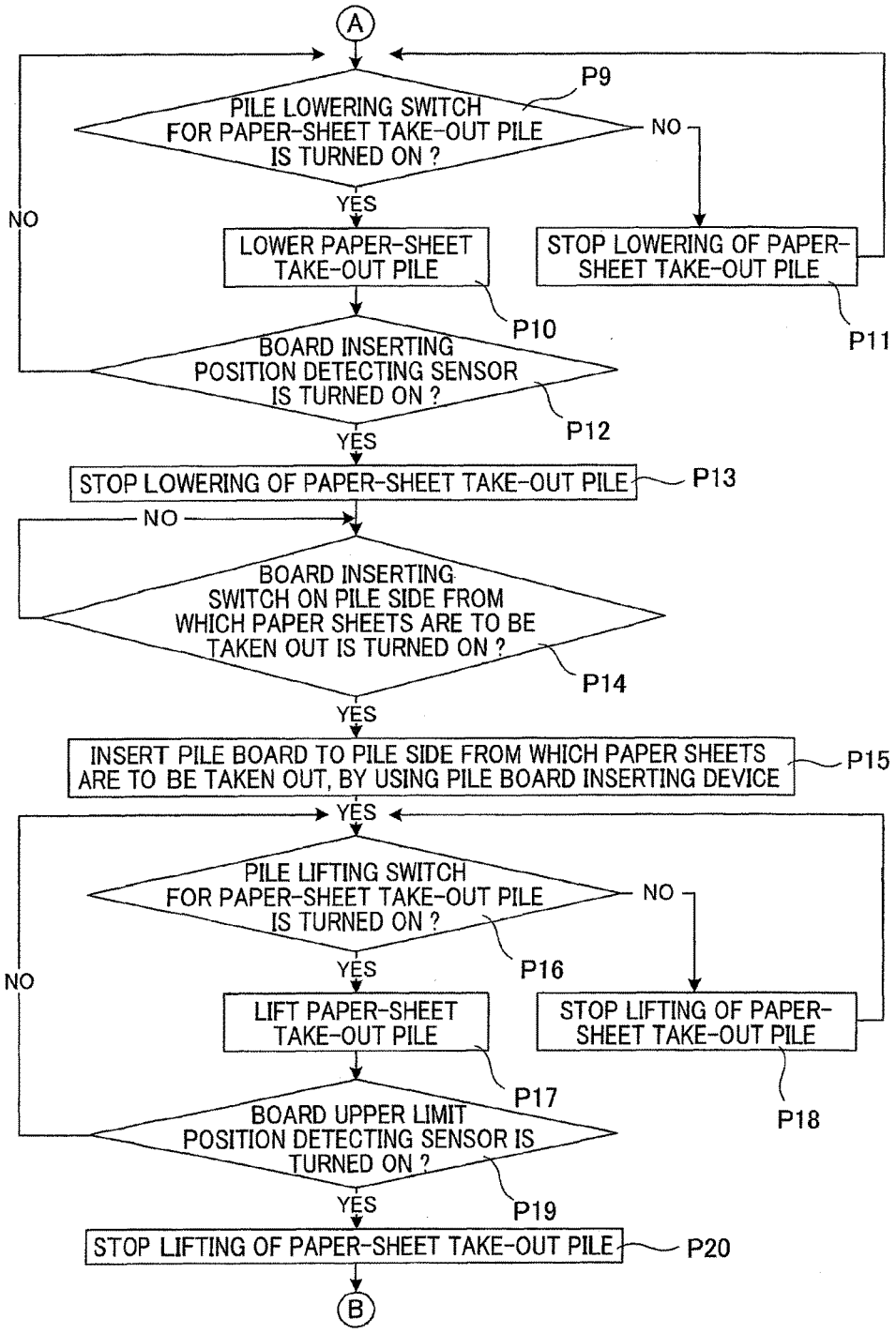
FIG. 12 is an operation flow diagram of the manual control in the discharging apparatus.
Figure 13:
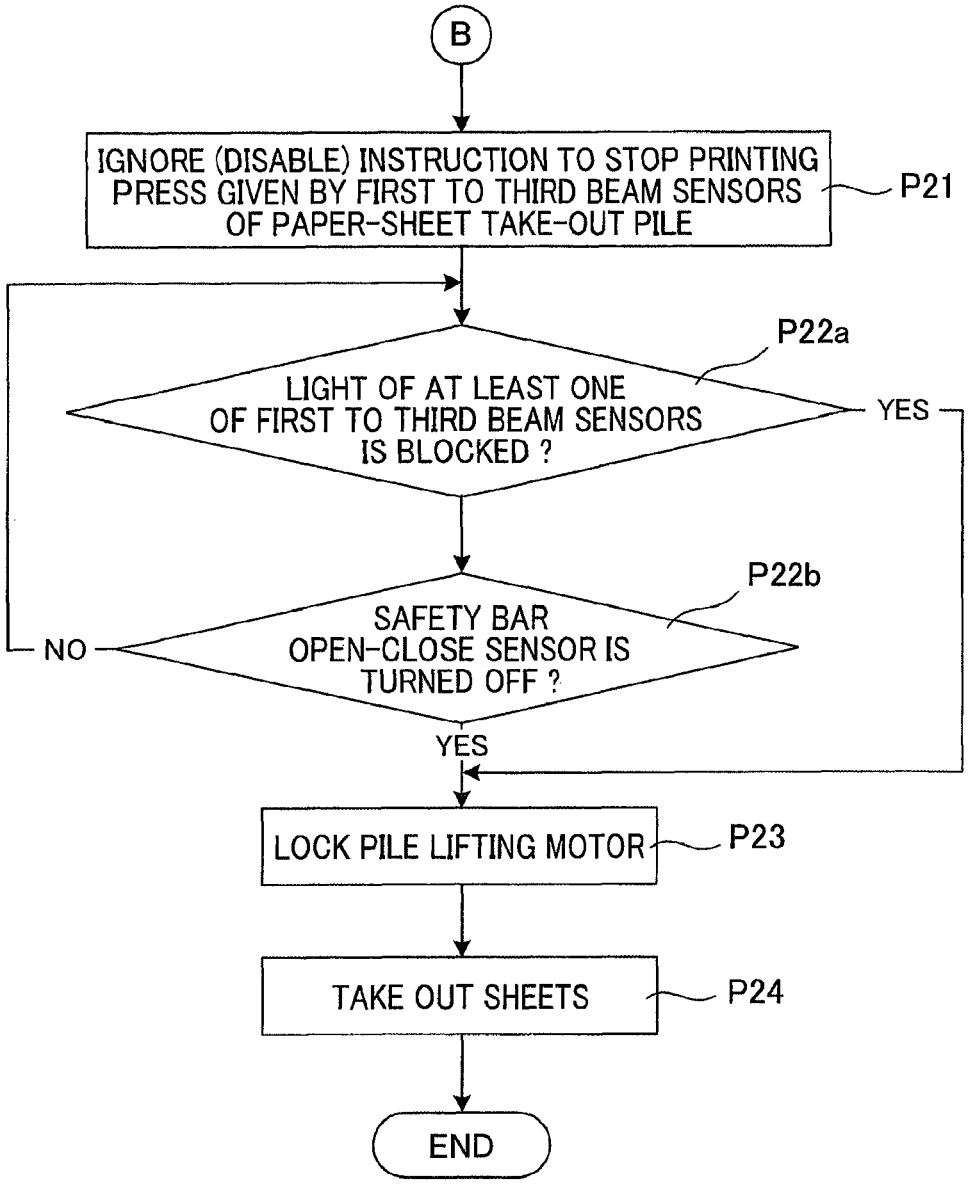
FIG. 13 is an operation flow diagram of the manual control in the discharging apparatus.

FIG. 1 is a schematic configuration diagram of an intaglio printing press which shows one embodiment of the present invention, FIG. 2 is an explanatory diagram of a piled paper-sheet take-out device and a pile board introducing device in a discharging apparatus, FIG. 3 is an explanatory diagram of a safety bar and the piled paper-sheet take-out device, FIG. 4 is a schematic explanatory diagram of a discharging method, FIG. 5 is a control block diagram of the discharging apparatus, FIG. 6 is a view of steps in an automatic control of the discharging apparatus, FIG. 7 is a view of steps in the automatic control of the discharging apparatus, FIG. 8 is a view of steps in the automatic control of the discharging apparatus, FIG. 9 is a view of steps in the automatic control of the discharging apparatus, FIG. 10 is a view of steps in the automatic control of the discharging apparatus, FIG. 11 is an operation flow diagram of a manual control in the discharging apparatus, FIG. 12 is an operation flow diagram of the manual control in the discharging apparatus, and FIG. 13 is an operation flow diagram of the manual control in the discharging apparatus.

As shown in FIG. 1, a feeder board 11 communicates with a paper-sheet feeding apparatus 10 being a sheet supplying apparatus on which paper sheets (sheets) W are piled, the feeder board 11 transporting paper sheets W sent out one by one from the top by a sucking device of the paper-sheet feeding apparatus 10. A swing arm shaft pregripper 12 configured to grip the paper sheet W on the feeder board 11 and swing is disposed for the feeder board 11.

An impression cylinder 14, which is a so-called triple-size cylinder and which has three grippers arranged at equal intervals in a circumferential direction to be capable of holding and transporting three paper sheets, communicates with the swing arm shaft pregripper 12 via a transfer cylinder 13 and is supported by a frame 23. A gripper similar to the grippers of the impression cylinder 14 is provided in the transfer cylinder 13 and the paper sheets W having been gripped by and received from the swing arm shaft pregripper 12 can be thereby passed to and gripped by the grippers of the impression cylinder 14.

An intaglio plate cylinder 15, which is a so-called triple-size cylinder and to which three intaglio plates can be attached in a circumferential direction, faces the impression cylinder 14 to be in contact therewith and is supported by the frame 23. An ink collecting cylinder 16, which is a so-called quadruple-size cylinder and to which four rubber blankets can be attached in a circumferential direction, faces the intaglio plates of the intaglio plate cylinder 15 to be in contact therewith and is supported by a frame 24. Five chablon rollers 17, which are each a so-called single cylinder and which have a circumferential length corresponding to the length of the blankets of the impression cylinder 14 and the intaglio plates of the intaglio plate cylinder 15, face the ink collecting cylinder 16 to be in contact therewith and are supported by the frame 24. Inking devices 18 configured to supply inks face the chablon rollers 17 to be in contact therewith, respectively, and are supported by a frame 25. The inking devices 18 are filled respectively with inks different from each other.

A wiping roller 19 faces the intaglio plates of the intaglio plate cylinder 15 to be in contact therewith. The wiping roller 19 is rotatably supported by a wiping tank 20 and is partially immersed in a cleaning solvent stored in the wiping tank 20 or is sprayed with the cleaning solvent in the wiping tank 20 by using a nozzle.

Moreover, a delivery cylinder 21 faces the impression cylinder 14 to be in contact therewith. Not-illustrated sprockets of a delivery apparatus (sheet transporting device) 22 are provided coaxially with the delivery cylinder 21. A pair of delivery chains 22*b* are wound around the sprockets of the delivery apparatus 22 and sprockets 22*a*. Not-illustrated delivery grippers are provided in the delivery chains 22*b*. First to third piles 26*a* to 26*c* each of which being a sheet discharging apparatus are arranged in a paper-sheet transporting direction, on a downstream side in the travelling direction of the delivery chains 22*b*.

The first pile 26*a* of a front stage and the second pile 26*b* of a middle stage is used for normal paper sheets and the normal paper sheets are alternately delivered onto pile boards 27*a*, 27*b* of the first and second piles 26*a*, 26*b* to be piled in multiple stages (for example, ten stages). Meanwhile, the third pile 26*c* of a rear stage is used for sample paper sheets and wasted paper sheets and the sample paper sheets and the wasted paper sheets are delivered onto pile boards 34 of the third pile 26*c* to be piled in multiple stages (for example, five stages).

Meanwhile, a window 24*a* is formed in the frame 24 on the frame 23 side thereof to allow a worker to enter and exit the printing press from the window 24*a*.

In such an intaglio printing press, the paper sheets W sent out one by one from the paper-sheet feeding apparatus 10 onto the feeder board 11 are transported by being passed from the swing arm shaft pregripper 12 to the grippers of the impression cylinder 14 via the transfer cylinder 13 to be gripped by the grippers. Meanwhile, the respective inks of the inking devices 18 are transferred onto the ink collecting cylinder 16 via the chablon rollers 17 and are supplied onto surfaces of the intaglio plates of the intaglio plate cylinder 15 while excessive inks are removed by the wiping roller 19. Then, the inks are transferred and printed onto the paper sheets W by causing the paper sheets W to pass through a portion between the impression cylinder 14 and the intaglio plate cylinder 15. The thus-printed paper sheets W are transported by the delivery chains 22*b* of the delivery apparatus 22 via the delivery cylinder 21 and are selectively delivered to the first to third piles 26*a* to 26*c*.

Moreover, in the embodiment, as shown in FIG. 2, a first beam sensor 62*a* (62*b*), a second beam sensor 63*a* (63*b*), a third beam sensor 64*a* (64*b*), and a safety bar 66*a* (66*b*) are disposed as safety devices in access regions of the first pile 26*a* and the second pile 26*b* in the delivery apparatus 22, and are supported by a frame of the delivery apparatus 22 as needed. In the illustrated example, an opening portion on a work side of each of the first pile 26*a* and the second pile 26*b* where a piled paper-sheet take-out device 70 to be described later advances and retreats is given as an example of the access region. However, the safety devices can be disposed also in an opening portion on a drive side of the first pile 26*a* and the second pile 26*b* where the pile boards 27*a* (27*b*) are inserted from a pile board inserting device 71 to be described later and also in an opening portion for maintenance and the like on a rear side of the first pile 26*a*, as a matter of course. The safety devices can be disposed also in an access region of the third pile 26*c*, as a matter of course.

The first beam sensor 62*a* (62*b*), the second beam sensor 63*a* (63*b*), and the third beam sensor 64*a* (64*b*) are provided away from each other at predetermined intervals in an up-down direction. These sensors are, for example, light projecting-receiving type detectors configured to detect an entry of an operator (and operation machines such as the piled paper-sheet take-out device 70) into the access region, and stop drive of a main unit motor 51 (see FIG. 5), i.e. stop the travelling of the delivery chains 22*b*, upon detecting the entry. However, under a certain condition to be described later, the main unit motor 51 is not stopped even when the entry is detected by the first beam sensor 62*a* (62*b*), the second beam sensor 63*a* (63*b*), and the third beam sensor 64*a* (64*b*).

The safety bar 66*a* (66*b*) is disposed in a fence shape to shield a lateral side of an upper space between the pair of delivery chains 22*b* of the delivery apparatus 22 and the pile board 27*a* (27*b*) located at the uppermost stage of the first pile 26*a* and the second pile 26*b*, and is supported to be movable between an entry preventing position at which the entry into the first and second piles 26*a*, 26*b* are prevented and an opened position at which the entry into the first and second piles 26*a*, 26*b* are allowed. When the safety bar 66*a* (66*b*) is manually set at the opened position, safety bar open-close sensors 61*a*, 61*b* (see FIG. 5) detects this and stops drive of pile lifting motors 53*a*, 53*b* (see FIG. 5) configured to lift and lower the pile boards 27*a* (27*b*) by causing endless chains (although the endless changes are not illustrated, refer to the endless chain travelling lines L3 in FIG. 2) in the first pile 26*a* and the second pile 26*b* to travel. Note that reference numeral 67*a* (67*b*) in FIG. 2 denotes a cover having a L-shaped cross section, and a horizontal plate portion thereof being flush with the pile board 27*a* (27*b*) at a board upper limit position (paper-sheet piling position) L2 (see FIG. 3) to be described later allows the cover to shield a lower surface and a side surface of the upper space described above and thus prevent entry into a sheet transporting region in which sheets are transported by the delivery chains 22*b* and gripper bars (not illustrated).

In the piled paper-sheet take-out device 70, multiple stages (ten stages, in the illustrated example) of fork members 70*c* are supported in a pectinate manner by an ascending-descending frame 70*b* which is supported on a wheeled platform 70*a* in such a way as to be capable of ascending and descending. The fork members 70*c* enter into the first pile 26*a* and the second pile 26*b* in the descending state of the ascending-descending frame 70*b* and then the ascending-descending frame 70*b* slightly ascends. All of the ten stages of pile boards 27*a* (27*b*) are thereby passed from the endless chain side in the first pile 26*a* and the second pile 26*b* to the fork members 70*c* supported by the ascending-descending frame 70*b*. The wheeled platform 70*a* retreats in this state to the outside of the first pile 26*a* and the second pile 26*b* and the take-out (unloading) of the ten stages of pile boards 27*a* (27*b*) is thereby made possible. Note that, since the piled paper-sheet take-out device 70 is publicly known in Patent Document 4 and the like, the detailed description thereof is omitted.

The pile board inserting device 71 lifts, one by one, the pile boards 27*a* (27*b*) stacked on a wheeled platform 71*a* to the height of a board inserting position L1 (see FIG. 3) of the first pile 26*a* and the second pile 26*b*, by using a lifter 71*b*. Thereafter, the pile board inserting device 71 pushes the pile boards 27*a* (27*b*) into the first pile 26*a* and the second pile 26*b* by using a pusher 71*c* and thus passes the pile boards 27*a* (27*b*) to the endless chain side in the first pile 26*a* and the second pile 26*b*. Note that, since the pile board inserting device 71 is publicly known in Patent Document 5 and the like, the detailed description thereof is omitted.

Moreover, as shown in FIG. 3, board inserting position detecting sensors 57*a*, 57*b* (see FIG. 5) such as limit switches or proximity sensors are provided at the board inserting position L1 which is the inserting position of the pile boards 27*a* (27*b*) while board upper limit position detecting sensors 58*a*, 58*b* (see FIG. 5) such as limit switches or proximity sensors are provided at the board upper limit position L2 which is the upper limit of the pile boards 27*a* (27*b*). Moreover, the set number (set amount) of the paper sheets W to be mounted on each of the pile boards 27*a* (27*b*) is counted by a counter 52 (see FIG. 5).

Accordingly, in the first pile 26*a* and the second pile 26*b*, as shown in FIG. 4, when the number of paper sheets W delivered onto the pile board 27*a* (27*b*) of the tenth stage reaches the set number with the safety bar 66*a* (66*b*) being set at the entry preventing position, the delivery of ten stages is completed and the pile is lowered (see part (a) of FIG. 4), the pile board 27*a* (27*b*) of the tenth stage having been lifted to the board upper limit position L2 after being inserted into the pile at the board inserting position L1.

Then, the pile is lowered by the travelling of the endless chains and the pile board 27*a* (27*b*) of the first stage of the next ten stages is inserted into (a board supporting member of) the twelfth stage at the board inserting position L1. In other words, (the board supporting member of) the eleventh stage is made pass without the pile board 27*a* (27*b*) being inserted therein (see part (b) of FIG. 4).

Next, the pile is lifted by the travelling of the endless chains and the pile board 27*a* (27*b*) of the twelfth stage is set at the board upper limit position L2 to allow the delivery of the paper sheets. Meanwhile, the safety bar 66*a* (66*b*) is set at the opened position to allow the entry of the piled paper-sheet take-out device 70 into the pile and the take-out (unloading) of the ten stages of pile boards 27*a* (27*b*) for which the piling is completed is thereby made possible (see part (c) of FIG. 4).

Such operations are performed alternately for the first pile 26*a* and the second pile 26*b*. In the embodiment, the operations can be performed in both of automatic control (operation) and manual control (operation).

Specifically, as shown in FIG. 5, the control device 50 described above receives a detection signal from the counter 52 and also receives operation signals from manual operation switches 54*a*, 54*b*, pile lowering switches 55*a*, 55*b*, pile lifting switches 56*a*, 56*b*, board inserting switches 59*a*, 59*b*, and pile changing switches 60*a*, 60*b* for the first pile 26*a* and the second pile 26*b* which are provided in a not-illustrated operation panel.

Similarly, the control device 50 receives detection signals from the safety bar open-close sensors 61*a*, 61*b*, the first beam sensors 62*a*, 62*b*, the second beam sensors 63*a*, 63*b*, and the third beam sensors 64*a*, 64*b*, in addition to detection signals from the aforementioned board inserting position detecting sensors 57*a*, 57*b*, the board upper limit position detecting sensors 58*a*, 58*b*, and paper-sheet height detecting sensors 65*a*, 65*b* for the first pile 26*a* and the second pile 26*b*.

Moreover, the control device 50 controls drive of the main unit motor 51 on the basis of various input signals to be described later and also controls drive of the pile lifting motors 53*a*, 53*b* of the first pile 26*a* and the second pile 26*b*.

The automatic control (operation) is performed according to the views of steps in the automatic control which are shown in FIGS. 6 to 10.

First, in step (a), when the counter 52 determines that the set number (set amount) of paper sheets W are discharged (piled) on the pile board 27*a* of the first stage of the first pile 26*a*, the discharge destination is changed in such a way that the paper sheets W are discharged to the second pile 26*b*.

Next, in step (b), the first pile 26*a* is lowered by the pile lifting motor 53*a* while the paper sheets W are discharged onto the pile board 27*b* of the first stage of the second pile 26*b*, the pile lifting motor 53*a* is stopped when the board supporting member of the second stage of the first pile 26*a* is detected by the board inserting position detecting sensor 57*a*, and the board supporting member of the second stage is thereby set at the board inserting position L1.

Subsequently, in step (c), the pile board 27*a* is inserted into the board supporting member of the second stage of the first pile 26*a* by the pile board inserting device 71.

Thereafter, in step (d), the first pile 26*a* is lifted by the pile lifting motor 53*a* and the pile board 27*a* of the second stage of the first pile 26*a* is thus set at the board upper limit position (paper-sheet piling position) by using the board upper limit position detecting sensor 58*a*. Then, when the counter 52 determines that the set number (set amount) of paper sheets W are discharged (piled) on the pile board 27*b* of the first stage of the second pile 26*b*, the discharge destination is changed in such a way that the paper sheets W are discharged to the first pile 26*a*.

Next, in step (e), the second pile 26*b* is lowered by the pile lifting motor 53*b*, the pile lifting motor 53*b* is stopped when the board supporting member of the second stage of the second pile 26*b* is detected by the board inserting position detecting sensor 57, and the board supporting member of the second stage is thereby set at the board inserting position L1.

Subsequently, in step (f), the pile board 27*a* is inserted into the board supporting member of the second stage of the second pile 26*a* by the pile board inserting device 71.

Thereafter, in step (g), the second pile 26*b* is lifted by the pile lifting motor 53*a*. Then, when the counter 52 determines that the set number (set amount) of paper sheets W are discharged (piled) on the pile board 27*a* of the second stage of the first pile 26*a*, the discharge destination is changed in such a way that the paper sheets W are discharged to the second pile 26*b*.

Operations described above are performed alternately for the first pile 26*a* and the second pile 26*b* and the paper sheets W are thus piled on the pile boards 27*a*, 27*b* of the third to ninth stages of the first pile 26*a* and the second pile 26*b*.

Next, in step (h), the paper sheets W are discharged on the pile board 27*a* of the tenth stage of the first pile 26*a*.

Subsequently, in step (i), when the counter 52 determines that the set number (set amount) of paper sheets W are discharged (piled) on the pile board 27*a* of the tenth stage of the first pile 26*a*, the discharge destination is changed in such a way that the paper sheets W are discharged to the second pile 26*b*. Then, a step of taking out (unloading) the ten stages of pile boards 27*a* of the first pile 26*a* for which the piling is completed is performed.

Specifically, in step (j), during the discharging of the paper sheets W to the second pile 26*b*, the first pile 26*a* is lowered by the pile lifting motor 53*a*, the pile lifting motor 53*a* is stopped when the board supporting member of the twelfth stage is detected by the board inserting position detecting sensor 57*a*, and the board supporting member of the twelfth stage is thereby set at the board inserting position L1, the twelfth stage being two stages above the pile board 27*a* of the tenth stage on which the paper sheets W have been piled.

Thereafter, in step (k), the pile board 27*a* is inserted into the board supporting member of the twelfth stage of the first pile 26*a* by the pile board inserting device 71. In other words, no pile board 27*a* is inserted into the board supporting member of the eleventh stage.

Next, in step (l), the first pile 26*a* is lifted by the pile lifting motor 53*a*, the pile lifting motor 53*a* is stopped when the board upper limit position detecting sensor 58*a* detects the pile board 27*a* of the twelfth stage of the first pile 26*a*, and the pile board 27 of the twelfth stage is thereby set at the board upper limit position.

Subsequently, in step (m), the piled paper-sheet take-out device 70 (wheeled platform 70*a*) advances to and retreats from the first pile 26*a* to take out (unload), from the pile, the ten stages of pile boards 27*a* (27*b*) for which the piling is completed. Then, when the counter 52 determines that the set number (set amount) of paper sheets W are discharged (piled) on the pile board 27*b* of the tenth stage of the second pile 26*b*, the discharge destination is switched in such a way that the paper sheets W are discharged to the first pile 26*a*.

Thereafter, in step (n), the second pile 26*b* is lowered by the pile lifting motor 53*b* during the discharging of the paper sheets W to the first pile 26*a* and an operation same as that in step (j) in the first pile 26*a* is performed also in the second pile 26*b*.

Next, in step (o), the pile board 27*b* is inserted into (the board supporting member of) the twelfth stage of the second pile 26*b* by the pile board inserting device 71 and an operation same as that in step (k) in the first pile 26*a* is performed also in the second pile 26*b*.

Next, in step (p), the second pile 26*b* is lifted by the pile lifting motor 53*b*, the pile lifting motor 53*b* is stopped when the board upper limit position detecting sensor 58*b* detects the pile board 27*b* of the twelfth stage of the second pile 26*b*, and the pile board 27 of the twelfth stage is thereby set at the board upper limit position. An operation same as that in step (l) in the first pile 26*a* is thus performed also in the second pile 26*b*. The take-out (unloading) of the ten stages of pile boards 27*a* of the first pile 26*a* for which the piling is completed is performed in a period between stage (m) and stage (p). Note that the machine is stopped unless the take-out (unloading) of the ten stages of pile boards 27*a* of the first pile 26*a* for which the piling is completed is performed before the set number of paper sheets W are discharged onto the pile board 27*a* of the twelfth stage of the first pile 26*a* in step (p).

Subsequently, in step (q), the piled paper-sheet take-out device 70 (wheeled platform 70*a*) advances to and retreats from the second pile 26*b* to take out (unload), from the pile, the ten stages of pile boards 27*b* for which piling is completed, and an operation same as that in step (m) in the first pile 26*a* is performed also in the second pile 26*b*.

Next, the flow proceeds to step (r) to step (t) and operations same as those in step (b) to step (d) are performed. Then, the take-out (unloading) of the ten stages of pile boards 27*b* of the second pile 26*b* for which the piling is completed is performed in a period between step (q) and step (t). Note that the machine is stopped unless the take-out (unloading) of the ten stages of pile boards 27*b* of the second pile 26*b* for which the piling is completed is performed before the set number of paper sheets W are discharged onto the pile board 27*b* of the twelfth stage of the second pile 26*b* in step (t).

Meanwhile, the manual control (operation) is performed according to the operation flow of the manual control which is shown in FIGS. 11 to 13.

First, in step P1, it is judged whether the paper sheets W are currently discharged to one of the first pile 26*a* and the second pile 26*b* from which the ten stages of piled paper sheets W are to be taken out. If yes, the pile changing switch 60*a* or 60*b* is operated to change the discharging to a different pile in step P2. Specifically, when the paper sheets W are discharged to the first pile 26*a*, the pile changing switch 60*b* for the second pile 26*b* is operated to change the discharging of the paper sheets W to the second pile 26*b* and, when the paper sheets W are discharged to the second pile 26*b*, the pile changing switch 60*a* for the first pile 26*a* is operated to change the discharging of the paper sheets W to the first pile 26*a*. Meanwhile, if no in step P1, the flow directly proceeds to step P3.

Next, when the manual operation switch 54*a* or 54*b* for the first pile 26*a* or the second pile 26*b* from which the paper sheets W are to be taken out is turned on in step P3, it is judged in step 4 whether the pile lowering switch 55*a* or 55*b* for the first pile 26*a* or the second pile 26*b* from which the paper sheets W are to be taken out is turned on. Note that, while each of the pile lowering switches 55*a*, 55*b* is operated, the corresponding pile is lowered and the lowering of the pile is stopped when the operation is stopped.

Subsequently, if yes in step P4, the first pile 26*a* or the second pile 26*b* which is the paper-sheet take-out pile is lowered by the pile lifting motor 53*a* or 53*b* in step P5. If no, the lowering of the first pile 26*a* or the second pile 26*b* which is the paper-sheet take-out pile is stopped in step P6 and the flow returns to step P4.

Thereafter, it is judged in step P7 whether the board inserting position detecting sensor 57*a* or 57*b* is turned on, i.e. whether the board inserting position detecting sensor 57*a* or 57*b* has detected the board supporting member one stage above the pile board 27*a* or 27*b* of the uppermost stage on which the paper sheets W have been piled. If yes, the lowering of the first pile 26*a* or the second pile 26*b* which is the paper-sheet take-out pile is stopped in step P8. If no, the flow returns to step P4.

Next, it is judged in step P9 whether the pile lowering switch 55*a* or 55*b* for the first pile 26*a* or the second pile 26*b* from which the paper sheets W are to be taken out is turned on. If yes, the first pile 26*a* or the second pile 26*b* which is the paper-sheet take-out pile is lowered by the pile lifting motor 53*a* or 53*b* in step P10. If no, the lowering of the first pile 26*a* or the second pile 26*b* which is the paper-sheet take-out pile is stopped in step P11 and the flow returns to step P9.

Subsequently, it is judged in step P12 whether the board inserting position detecting sensor 57*a* or 57*b* is turned on. If yes, the lowering of the first pile 26*a* or the second pile 26*b* which is the paper-sheet take-out pile is stopped in step P13, i.e. the board supporting member two stages above the pile board 27*a* or 27*b* of the uppermost stage on which the paper sheets W have been piled is stopped at the board inserting position L1. If no, the flow returns to step P9.

Thereafter, when the board inserting switch 59*a* or 59*b* on the first pile 26*a* side or the second pile 26*b* side which is the paper-sheet take-out pile is turned on in step P14, the pile board 27*a* or 27*b* is inserted to the first pile 26*a* side or the second pile 26*b* side which is the paper-sheet take-out pile, by the pile board inserting device 71 in step P15. In other words, the pile board 27*a* or 27*b* is inserted into (the board supporting member of) a stage that is two stages above the pile board 27*a* or 27*b* of the uppermost stage on which the paper sheets W have been piled.

Next, it is judged in step P16 whether the pile lifting switch 56*a* or 56*b* for the first pile 26*a* or the second pile 26*b* from which the paper sheets W are to be taken out is turned on. If yes, the first pile 26*a* or the second pile 26*b* which is the paper-sheet take-out pile is lifted by the pile lifting motor 53*a* or 53*b* in step P17. If no, the lifting of the first pile 26*a* or the second pile 26*b* which is the paper-sheet take-out pile is stopped in step P18 and the flow returns to step P16.

Subsequently, it is judged in step P19 whether the board upper limit position detecting sensor 58*a* or 58*b* is turned on. If yes, the lifting of the first pile 26*a* or the second pile 26*b* which is the paper-sheet take-out pile is stopped in step P20, i.e. (the board supporting member of) a stage that is two stages above the pile board 27*a* or 27*b* of the uppermost stage on which the paper sheets W have been piled is stopped at the board upper limit position L2. If no, the flow returns to step P16.

Thereafter, in step P21, an instruction to stop the drive device of the printing press given by the first beam sensor 62*a* or 62*b*, the second beam sensor 63*a* or 63*b*, and the third beam sensor 64*a* or 64*b* of the first pile 26*a* or the second pile 26*b* which is the paper-sheet take-out pile are ignored (disabled). Then, when light of at least one of the first beam sensor 62*a* or 62*b*, the second beam sensor 63*a* or 63*b*, and the third beam sensor 64*a* or 64*b* is blocked (turned off) in step P22*a* or the safety bar open-close sensor 61*a* or 61*b* is turned off (the safety bar is opened) in step P22*b*, the drive of the pile lifting motor 53*a* or 53*b* is stopped (locked) in step P23.

Next, in step P24, the piled paper-sheet take-out device 70 (wheeled platform 70*a*) advances to and retreats from the first pile 26*a* or the second pile 26*b* which is the paper-sheet take-out pile and the ten stages of pile boards 27*a* or 27*b* for which the piling is completed are taken out (unloaded) from the pile.

Hereafter, the operations of steps P1 to steps P23 described above are repeated.

As described above, in the embodiment, when the stacking of paper sheets W onto the ten stages of pile boards 27*a* or 27*b* is completed in the first pile 26*a* or the second pile 26*b* and the ten stages of pile boards 27*a* or 27*b* for which the piling is completed are to be taken out (unloaded) from the pile, the first pile 26*a* or the second pile 26*b* is first lowered until the board supporting member two stages above the pile board 27*a* or 27*b* of the uppermost stage on which the paper sheets W have been piled reaches the board inserting position L1.

Next, when the board supporting member two stages above reaches the board inserting position L1, the lowering of the first pile 26*a* or the second pile 26*b* is stopped and the pile board 27*a* or 27*b* of the first stage (i.e. twelfth stage) on which no paper sheets W are piled yet is inserted to start the piling (delivery) of the paper sheets W for the next ten stages of pile boards 27*a* or 27*b*.

Subsequently, the first pile 26*a* and the second pile 26*b* are lifted and the lifting of the first pile 26*a* or the second pile 26*b* is stopped when the pile board 27*a* or 27*b* of the first stage for which the piling is not performed yet reaches the board upper limit position (paper-sheet piling position) L2. In this state, the ten stages of pile boards 27*a* or 27*b* for which the piling is completed are taken out (unloaded) from the pile by using the piled paper-sheet take-out device 70.

Moreover, in the embodiment, when the pile board 27*a* or 27*b* of the first stage for which the piling is not performed yet reaches the board upper limit position (paper-sheet piling position) L2, the instruction to stop the drive device of the printing press given by the first beam sensor 62*a* or 62*b*, the second beam sensor 63*a* or 63*b*, and the third beam sensor 64*a* or 64*b* are automatically ignored (disabled) in the control device 50. In addition, in this state, since no pile board 27*a* or 27*b* is inserted in one stage between the pile board 27*a* or 27*b* of the first stage for which the piling is not performed yet and the pile board 27*a* or 27*b* of the uppermost stage on which the paper sheets W have been piled, the paper sheets W on the pile board 27*a* or 27*b* of the uppermost stage do not interfere with the pile board 27*a* or 27*b* of the first stage for which the piling is not performed yet, even when the ten stages of pile boards 27*a* or 27*b* for which the piling is completed are slightly lifted by (the fork members 70*c* of) the piled paper-sheet take-out device 70 during the take-out (unloading).

This allows the ten stages of pile boards 27*a* or 27*b* for which the piling is completed to be smoothly taken out without stopping the drive device (printing press) during the take-out (unloading) thereof. Accordingly, the operation rate of the printing press can be improved.

Furthermore, when the pile board 27*a* or 27*b* of the first stage for which the piling is not performed yet is set at the board upper limit position (paper-sheet piling position) L2, the pile board 27*a* or 27*b* can partition the upper space between the delivery chains 22*b* of the delivery apparatus 22 and the pile board 27*a* or 27*b* on the uppermost stage on which the paper sheets W have been piled, and shield the lower surface side (travelling region) of the delivery chains 22*b* to prevent entry of foreign objects, thereby improving the safety. In the illustrated example, since the pile board 27*a* or 27*b* at the board upper limit position (paper-sheet piling position) L2 is flush with the horizontal plate portion of the cover 67*a* or 67*b* having the L-shaped cross section and the shielding of a larger area is made possible in the lower surface and the side surface of the upper space, the safety is further improved. Moreover, using a transparent material for the cover 67*a* or 67*b* allows viewing through the cover 67*a* or 67*b*, and monitoring of the interior is thereby made possible.

Moreover, when the light of at least one of the first beam sensor 62*a* or 62*b*, the second beam sensor 63*a* or 63*b*, and the third beam sensor 64*a* or 64*b* is blocked or the safety bar 66*a* or 66*b* is set at the opened position during the take-out (unloading), the drive of the pile lifting motor 53*a* or 53*b* configured to lift and lower the pile boards 27*a* or 27*b* is stopped (locked). Accordingly, unintentional lifting and lowering of the pile board 27*a* or 27*b* is avoided during the advancing and retreating of the piled paper-sheet take-out device 70 (wheeled platform 70*a*). Hence, the take-out (unloading) can be safely performed even in a continuous operation of the drive device (printing press). As a matter of course, the safety bar 66*a* or 66*b* has a function of preventing an entry into the access regions in times other than the take-out (unloading) and serves as a back-up in a failure or an erroneous operation of the first beam sensor 62*a* or 62*b*, the second beam sensor 63*a* or 63*b*, and the third beam sensor 64*a* or 64*b*.

Note that the present invention is not limited to the embodiment described above and various changes can be made within the spirit of the present invention, as a matter of course. For example, the number of piles and the number of stages of pile boards can be changed. Moreover, the stage skipped of insertion of the pile board is not limited to one stage and multiple stages may be skipped of insertion.

INDUSTRIAL APPLICABILITY

The sheet discharging apparatus and the sheet discharging method of the present invention can be applied to a so-called special intaglio printing press for printing banknotes, securities, and the like.

EXPLANATION OF THE REFERENCE NUMERALS

10 PAPER-SHEET FEEDING APPARATUS
11 FEEDER BOARD
12 SWING ARM SHAFT PREGRIPPER
13 TRANSFER CYLINDER
14 IMPRESSION CYLINDER
15 INTAGLIO PLATE CYLINDER
16 INK COLLECTING CYLINDER
17 CHABLON ROLLER
18 INKING DEVICE
19 WIPING ROLLER
20 WIPING TANK
21 DELIVERY CYLINDER
22 DELIVERY APPARATUS
23, 24, 25 FRAME
24*a* WINDOW
26*a* to 26*c* FIRST TO THIRD PILES
27*a*, 27*b* PILE BOARD
34 PILE BOARD
50 CONTROL DEVICE
51 MAIN UNIT MOTOR
52 COUNTER
52 COUNTER
53*a*, 53*b* PILE LIFTING MOTOR
54*a*, 54*b* MANUAL OPERATION SWITCH
55*a*, 55*b* PILE LOWERING SWITCH
56*a*, 56*b* PILE LIFTING SWITCH
57*a*, 57*b* BOARD INSERTING POSITION DETECTING SENSOR
58*a*, 58*b* BOARD UPPER LIMIT POSITION DETECTING SENSOR
59*a*, 59*b* BOARD INSERTING SWITCH
60*a*, 60*b* PILE CHANGING SWITCH
61*a*, 61*b* SAFETY BAR OPEN-CLOSE SENSOR
62*a*, 62*b* FIRST BEAM SENSOR
63*a*, 63*b* SECOND BEAM SENSOR
64*a*, 64*b* THIRD BEAM SENSOR
66*a*, 66*b* SAFETY BAR
67*a*, 67*b* COVER
70 PILED PAPER-SHEET TAKE-OUT DEVICE
70*a* WHEELED PLATFORM
70*b* ASCENDING-DESCENDING FRAME
70*c* FORK MEMBER
71 PILE BOARD INSERTING DEVICE
71*a* WHEELED PLATFORM
71*b* LIFTER
71*c* PUSHER
L1 BOARD INSERTING POSITION
L2 BOARD UPPER LIMIT POSITION
L3 ENDLESS CHAIN TRAVELLING LINE
W PAPER SHEET

The invention claimed is:

1. A sheet discharging apparatus, comprising:

a sheet transporting device configured to transport sheets;

a pile having a plurality of stages of pile boards on which sheets discharged from the sheet transporting device are piled;

an entry detector configured to detect an entry of an operator into the pile and stop the sheet transporting device;

a sheet piling position detector configured to detect that a pile board of an uppermost stage among the plurality of stages of pile boards is set at a sheet piling position; and a control device configured to disable the stopping of the sheet transporting device due to the detection by the entry detector, on the basis of a detection signal from the sheet piling position detector, wherein the sheet piling position of the pile board is a position at which an entry of an operator into a sheet transporting region is prevented, and wherein the sheet piling position of the pile board detected by the sheet piling position detector is a board upper limit position which is an upper limit of the pile board, and the pile board of the uppermost stage among the plurality of stages of pile boards which is located at the upper limit position shields a lower surface of a sheet transporting region.

2. The sheet discharging apparatus according to claim 1, wherein a cover is provided adjacent to the pile board set at the sheet piling position and the entry of the operator into the sheet transporting region is prevented by the cover and the pile board.

3. The sheet discharging apparatus according to claim 1, further comprising:

a safety bar supported to be movable between an entry preventing position at which the entry into the pile is prevented and an opened position at which the entry into the pile is allowed; and a sensor configured to detect a position of the safety bar, wherein the control device controls a pile lifting motor configured to lift and lower the pile boards, on the basis of a detection signal from the sensor.

4. A sheet discharging method in a sheet discharging apparatus including:

a sheet transporting device configured to transport sheets;

a pile having a plurality of stages of pile boards on which sheets discharged from the sheet transporting device are piled; and an entry detector configured to detect an entry of an operator into the pile and stop the sheet transporting device, the sheet discharging method, comprising:

the step of detecting that one of the pile boards is set at a sheet piling position and then disabling the stop of the sheet transporting device due to the detection by the entry detector, wherein an entry of an operator into a delivery chain travelling region above the pile in the sheet transporting device is prevented by the pile board set at the sheet piling position, and wherein the sheet piling position is a board upper limit position which is an upper limit of the pile board, and the pile board of the uppermost stage among the plurality of stages of pile boards which is located at the upper limit position shields a lower surface of a sheet transporting region, and wherein a plurality of the piles are provided in a sheet transporting direction in the sheet discharging apparatus and, when discharging of the sheets onto the pile board of an uppermost stage of one of the piles is completed, discharging of the sheets onto the pile board of an uppermost stage of another one of the piles is performed, and when the pile boards on which the sheets have been piled are to be taken out from the one pile, the method comprising the steps of:

lowering the pile boards on which the sheets have been piled;

inserting a pile board into a stage at least two stages above the pile board of the uppermost stage on which the sheets have been piled;

lifting and setting the inserted pile board at the sheet piling position;

detecting that the inserted pile board is set at the sheet piling position and disabling the stop of the sheet transporting device due to the detection by the entry detector; and taking out the pile boards on which the sheets have been piled by causing a piled paper-sheet take-out device to advance to and retreat from the sheet discharging apparatus, and the steps are performed in this order.

5. The sheet discharging method according to claim 4, wherein, when the entry detector detects the entry into the sheet discharging apparatus while the drive stopping of the sheet transporting device due to the detection by the entry detector is disabled, drive of a pile lifting motor configured to lift and lower the pile boards is stopped.

6. A sheet discharging method in a sheet discharging apparatus including:

a sheet transporting device configured to transport sheets;

a pile having a plurality of stages of pile boards on which sheets discharged from the sheet transporting device are piled; and an entry detector configured to detect an entry of an operator into the pile and stop the sheet transporting device, the sheet discharging method, comprising:

the step of detecting that one of the pile boards is set at a sheet piling position and then disabling the stop of the sheet transporting device due to the detection by the entry detector, wherein an entry of an operator into a delivery chain travelling region above the pile in the sheet transporting device is prevented by the pile board set at the sheet piling position, and wherein the sheet piling position is a board upper limit position which is an upper limit of the pile board, and the pile board of the uppermost stage among the plurality of stages of pile boards which is located at the upper limit position shields a lower surface of a sheet transporting region, and wherein, when a sensor detects an opening operation of a safety bar disposed adjacent to the sheet transporting region while the drive stopping of the sheet transporting device due to the detection by the entry detector is disabled, drive of a pile lifting motor configured to lift and lower the pile boards is stopped.

* * * * *